US009863733B2

(12) United States Patent
Kokinis et al.

(10) Patent No.: US 9,863,733 B2
(45) Date of Patent: Jan. 9, 2018

(54) BARREL WITH INTEGRATED GAS CHANNEL

(71) Applicant: MACHINEGUNARMORY, LLC, Sandy, UT (US)

(72) Inventors: John Kokinis, Sandy, UT (US); Daniel Fisher, Fredericksburg, TX (US)

(73) Assignee: MACHINE GUN ARMORY, L.L.C., Sandy, UT (US)

( * ) Notice: Subject to any disclaimer, the term of this patent is extended or adjusted under 35 U.S.C. 154(b) by 0 days.

(21) Appl. No.: 14/595,976

(22) Filed: Jan. 13, 2015

(65) Prior Publication Data

US 2016/0202012 A1 Jul. 14, 2016

(51) Int. Cl.
*F41A 21/28* (2006.01)
*F41A 21/00* (2006.01)
*F41A 5/26* (2006.01)

(52) U.S. Cl.
CPC ..... *F41A 21/28* (2013.01); *F41A 5/26* (2013.01)

(58) Field of Classification Search
CPC ..... F41A 5/18; F41A 5/20; F41A 5/22; F41A 5/24; F41A 5/26; F41A 5/28; F41A 5/30
USPC ..... 89/191.01, 191.02, 192, 193
See application file for complete search history.

(56) References Cited

U.S. PATENT DOCUMENTS 2,641,162 A * 6/1953 Balleisen ..... F41A 13/04 251/77
2,865,256 A 12/1958 Marsh
2,929,164 A * 3/1960 Browning ..... F41A 21/24 42/112
3,359,860 A 12/1967 Muhlcmann
3,665,804 A 5/1972 Rohr
3,858,481 A 1/1975 Elliott
4,611,525 A 9/1986 Bosshard et al.
4,619,184 A * 10/1986 Shalev ..... F41A 3/86 89/185
4,798,124 A 1/1989 Hurlemann et al.
4,982,648 A * 1/1991 Bol ..... F41A 21/24 42/76.02
5,740,626 A 4/1998 Schuetz et al.
2010/0282065 A1 11/2010 Stone
2011/0277623 A1* 11/2011 Adolphsen ..... F41A 5/06 89/193
2012/0167756 A1* 7/2012 Larue ..... F41A 21/28 89/193
2013/0276624 A1* 10/2013 Crommett ..... F41A 5/26 89/193
2013/0291713 A1* 11/2013 Zheng ..... F41A 5/20 89/191.02

(Continued)

OTHER PUBLICATIONS

Notification of Transmittal of the International Search Report and the Written Opinion of the International Searching Authority, or the Declaration, from PCT/US 15/67657 dated Jul. 15, 2016 (14 pages).

*Primary Examiner* — Bret Hayes
(74) *Attorney, Agent, or Firm* — Workman Nydegger

(57) ABSTRACT

A firearm barrel has a gas channel in fluid communication with a gas port. The gas port diverts a portion of the gas produced when firing a round of ammunition into the gas channel. The gas channel extends longitudinally and substantially parallel to a longitudinal axis of the barrel to a gas block. The gas channel provides fluid communication between a gas block and a gas port located in different longitudinal positions on the barrel.

18 Claims, 7 Drawing Sheets

(56) References Cited

U.S. PATENT DOCUMENTS

| | | | | |
|---|---|---|---|---|
| 2014/0260947 | A1 | 9/2014 | Gomez | |
| 2014/0305297 | A1* | 10/2014 | Hall | F41A 5/26 89/193 |
| 2015/0260468 | A1* | 9/2015 | Foster | F41A 3/72 89/191.01 |
| 2016/0003566 | A1* | 1/2016 | Gomirato | F41A 5/28 89/193 |

* cited by examiner

BARREL WITH INTEGRATED GAS CHANNEL

BACKGROUND

Semi-automatic and fully-automatic firearms may be designed to automatically expel the cartridge of a fired round of ammunition and chamber a new round of ammunition without the intervention of an operator. Such self-feeding of ammunition to a firearm is used to provide high rates of fire through both semi-automatic and fully-automatic firearms. The self-feeding operation may be performed by the internal operating group of the firearm using a variety of mechanism. A firearm may use the expanding gas from the fired round and/or the recoil from the fired round to provide energy to feed a new round of ammunition into the firearm.

In a closed-bolt firearm, a cycle of the firearm may include moving a firing pin to detonate a round in a chamber, retracting a bolt from the chamber, removing the casing of the fired round from the chamber, ejecting the casing of the fired round from the firearm, advancing a new round into alignment with the chamber, chambering the new round and closing securing the bolt to chamber the round. In an open-bolt firearm, a cycle of the firearm may include moving a bolt and firing pin forward, striking a round of ammunition, moving the bolt away from the chamber, removing the casing of the fired round from the chamber, ejecting the casing of the fired round from the firearm, and advancing a new round into alignment with the chamber. In both closed-bolt and open-bolt firearms, a cycle of the firearm includes advancing the next round into alignment with the chamber.

Each subsequent round may be moved into alignment with the chamber from a feed system. In some feed systems, each subsequent round is advanced by a mechanism independent of a cycle of the firearm. For example, a round may be moved from a storage position into alignment with the chamber by a mechanism in the ammunition storage device, such as in a magazine. In a magazine, multiple rounds of ammunition are stored with a follower at one end of the magazine. The follower may be a spring-loaded follower, or may include another mechanism to urge the rounds towards the chamber. A firearm using a magazine may passively have each subsequent round provided to the firearm such as in a semi-automatic handgun.

In other feed systems, each subsequent round is moved into alignment with the chamber by an operation of the firearm during each cycle. For example, a firearm including a clip may move each subsequent round from the clip to alignment with the chamber without an advancement mechanism in the clip. The entire clip and associated ammunition may move relative to a body of the firearm via an actuation mechanism of the firearm. The energy to move each round of the ammunition and/or move the clip may be provided by the firing of the gun, such as in a gas operated or gas-piston operated firearm, or by other sources, such as an electric motor. In a firearm that advances each subsequent round of ammunition by harnessing some of the energy of the firing of the gun, the energy may be harnessed by a gas-piston operating group, a gas impingement operating group, or a similar type of gas pressure activated operating group. The gas pressure activated operating group may convert at least some of the energy of an expanding gas within the firearm to a linear force to cycle the firearm.

Different firearms and different ammunitions may produce different gas pressures within the firearm when a round of ammunition is fired. The expanding gas forces a bullet or group of pellets down the barrel as the gas expands. The gas pressure is greatest at the start of the expansion and least near the terminal end of the barrel before the expanding gas is unconstrained and expands freely outside the barrel.

SUMMARY

The following summary is provided to introduce a selection of concepts that are further described below in the detailed description. This summary is not intended to identify specific features of the claimed subject matter, nor is it intended to be used as an aid in limiting the scope of the claimed subject matter.

A barrel for a firearm of the present disclosure increases the amount of energy harnessed from the expanding gas behind a bullet by having a gas port near the proximal end of the barrel that is in communication with the bore of the barrel. The gas pressure is highest near the chamber of the firearm and a gas port near the chamber, i.e., near the proximal end of the barrel, will experience the high gas pressure for a longer period of time than a gas port located closer to the distal end of the barrel. A gas channel in communication with the gas port directs the diverted portion of the expanding gas toward an aperture communicating with the gas block where the gas is used to cycle an operating group of the firearm.

A barrel of the present disclosure includes an elongated body with a central bore extending therethrough. The barrel also includes a gas channel that extends longitudinally along a length of the barrel and substantially parallel to the central bore and which is in fluid communication with the central bore in the elongated body.

In one embodiment, a firearm includes a barrel having a central bore extending from a proximal end to a distal end with a gas port located in fluid communication with the central bore of the barrel. The firearm also includes a gas cylinder and a gas channel extending longitudinally and substantially parallel to the central bore and providing fluid communication between the central bore and the gas cylinder.

In another embodiment, a method of diverting expanding gas in a firearm comprises directing an expanding gas longitudinally in a central bore, diverting a least a portion of the expanding gas laterally into a gas port, channeling a diverted gas longitudinally through a gas channel, and transferring energy from the diverted gas to an operating group.

Additional features of embodiments of the disclosure will be set forth in the description which follows. The features of such embodiments may be realized by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

Figure 1:
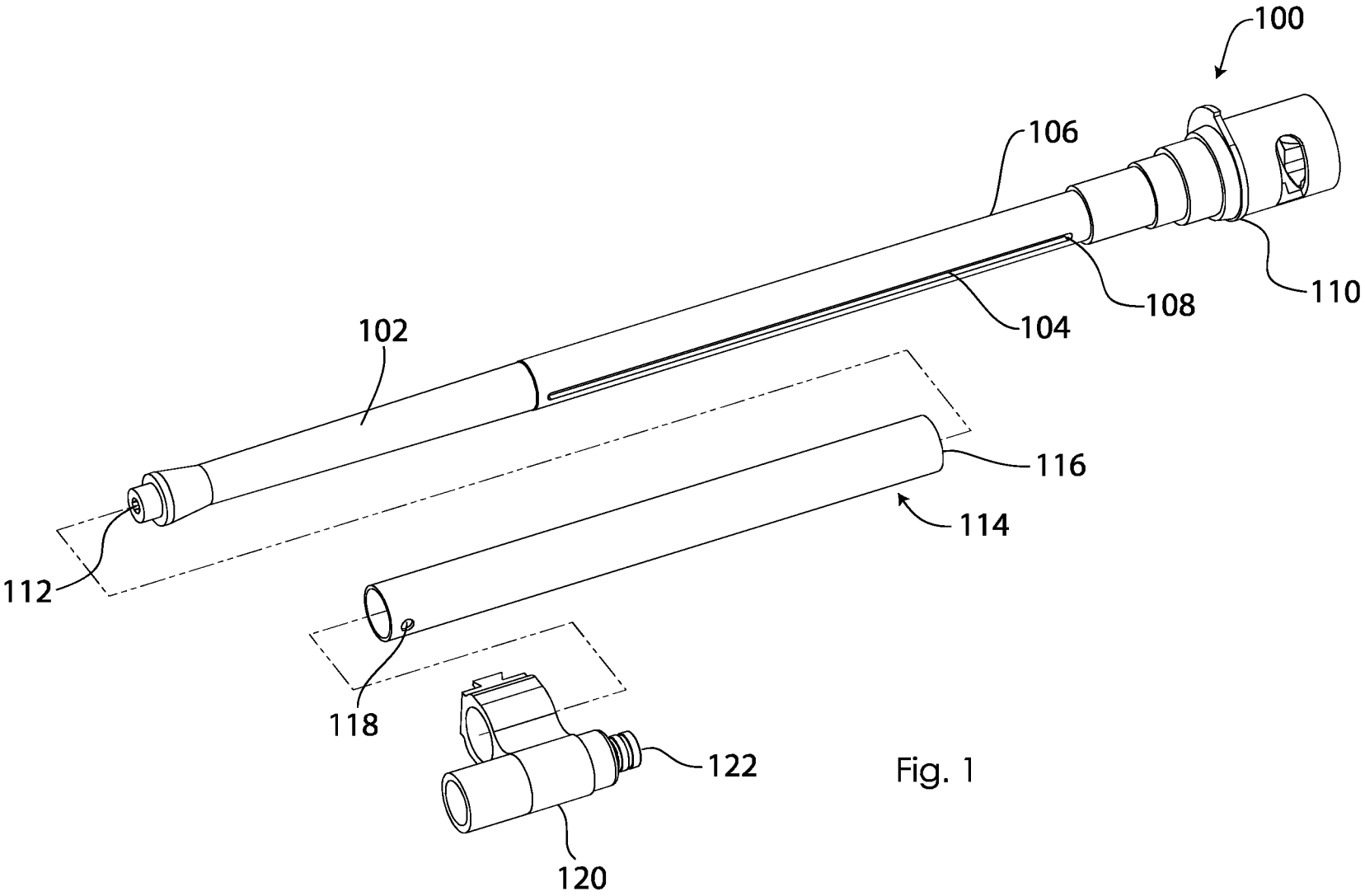
FIG. 1 is an exploded view of a barrel having an integrated gas channel, a channel housing and a gas block, according to at least one embodiment described herein.

The following description relates generally to the delivery of ammunition to a self-feeding firearm. The following description describes various embodiments of devices, systems, and methods of harnessing the energy of expanding gas from firing a round of ammunition to deliver another round of ammunition to a self-feeding firearm. The described embodiments should be understood to illustrate one or more features of the present disclosure. One or more features disclosed in relation to any embodiment described herein may be freely combined with one or more features of any other embodiment or embodiments described herein.

A firearm uses expanding gases to accelerate one or more projectiles (e.g., a bullet or a plurality of shot pellets) down a barrel toward the muzzle of the barrel before the projectile and gas are unconstrained and the gas can no longer effectively accelerate the projectile or projectiles. The barrel may include a lateral gas port in the barrel to divert at least part of the expanding gas away from the barrel. The energy of diverted expanding gas may be used to move an operating group of the firearm to cycle the firearm.

Cycling the firearm may include moving a bolt, feeding a new round of ammunition into the chamber, resetting a firing pin, other functions in the firearm, or combinations thereof. In gas-piston systems, the diverted gas may be directed into a gas cylinder to apply a force to a piston head and move an operating rod ("op rod") in a first direction, while an op rod spring applies a restoring force against the movement of the op rod, producing a reciprocating motion to cycle the firearm. In direct impingement or gas-impingement systems, the diverted gas may apply a force directly to the bolt and/or carrier to cycle the firearm.

In some firearms, the operating group may cycle many times per second, and therefore, the energy of the expanding gas diverted from the barrel through the gas port may need to be regulated to provide reliable operation of the firearm. Changing the ammunition and/or caliber of a firearm may result in a significant change in the energy of the expanding gas diverted from the barrel through the gas port. For example, in a firearm with subsonic muzzle velocities, the expanding gas may have an energy that is too low to properly cycle the firearm.

A firearm may have a gas port that is located in the barrel closer to the chamber than the initial position of the piston head. For example, the piston head may be located at approximately a midpoint of the barrel and the gas cylinder may have a length of approximately half the length of the barrel. The barrel may have a gas port that is located between the chamber and the piston head. The gas port may direct gas into a gas channel that extends toward to the muzzle of the barrel and away from the chamber. The gas channel may, thereby, direct high energy gas from proximate the chamber to a gas cylinder entrance that is farther from the chamber. The gas channel diverting gas away from the barrel earlier in the movement of the projectile along the length of the barrel (i.e., closer to the chamber) may allow a firearm to utilize longer dwell time for the gas pressure before the projectile exits the barrel and the expanding gas is unconstrained. Firearms may be designed and/or converted to use lower energy ammunition and/or lower muzzle-velocities, therefore, by harnessing energy from the firing of the round for a longer period of time with little or substantially no alteration of the operation group.

FIG. 1 is an exploded perspective view of a barrel 100 having a body 102 with an integrated gas channel 104, according to at least one embodiment of the present disclosure. The barrel 100 has an elongated barrel body 102 with a gas channel 104 formed in an outer surface 106 thereof. While the barrel body 102 is depicted in FIG. 1 as being substantially circular in transverse cross-section, the barrel body of the present disclosure may, in other embodiments, have other shapes in transverse cross-section including but not limited to elliptical, polygonal, irregular, or combinations thereof. For example, the barrel body may have fluting therein to reduce weight and/or heat dissipation. The barrel body 102 has a longitudinal axis extending through the center of the barrel body 102.

The barrel body 102 may be made of or include metal, such as a steel alloy, titanium alloy, aluminum alloy, superalloy, other alloy, or a combination thereof. In some embodiments, the steel alloy may include alloying elements such as a carbon, manganese, nickel, chromium, molybdenum, tungsten, vanadium, silicon, boron, lead, other appropriate alloying elements, or combinations thereof. In some embodiments, the titanium alloy may include alloying elements such as aluminum, vanadium, palladium, nickel, molybdenum, ruthenium, niobium, silicon, oxygen, iron, other appropriate alloying elements, or combinations thereof. In some embodiments, the aluminum alloy may include alloying elements such as silicon, iron, copper, manganese, magnesium, chromium, zinc, vanadium, titanium, bismuth, gallium, lead, zircon, other appropriate alloying elements, or combinations thereof. In some embodiments, the superalloy may include elements such as nickel, cobalt, iron, chromium, molybdenum, tungsten, tantalum, aluminum, titanium, zirconium, rhenium, yttrium, boron, carbon, another appropriate alloying element, or combinations thereof. The barrel body 102 may be made of or include a non-metal, such as a polymer, a ceramic, other non-metal, or combinations thereof. The barrel body 102 may be made of or include a combination of metal and non-metal materials.

In the embodiment depicted in FIG. 1, the gas channel 104 is integrated into the barrel body 102 of the barrel 100 such that the barrel body 102 of the barrel 100 defines the gas channel 104. The gas channel 104 is located in an outer surface 106 of the barrel body 102. For example, the gas channel 104 may be milled into the outer surface 106 of the barrel body 102. The gas channel 104 is in fluid communication with a gas port 108 that extends laterally from a central bore of the barrel 100 to the gas channel 104 to divert expanding gas from the central bore to the gas channel 104. The gas port 108 is located near a proximal end 110 of the barrel body 102 near the chamber of the firearm. The gas channel 104 extends longitudinally along a length of the barrel body 102 from the gas port 108 toward a distal end 112 of the barrel body 102.

The barrel 100 further has a channel housing 114 that borders and encloses the gas channel 104. The channel housing 114 may be made of or include any material of which the barrel body 102 may be made or include. The channel housing 114, as depicted in FIG. 1, is a sleeve 116 that may be positioned circumferentially around the barrel body 102. The sleeve 116 may have an interference fit with the outer surface 106 of the barrel body 102. In some embodiments, the interference fit may limit or substantially prevent the movement of gas or other fluid between the sleeve 116 and the barrel body 102. In other embodiments, a sealant may be located between the sleeve and the barrel body 102 to limit or substantially prevent movement of gas or other fluid between the sleeve 116 and the barrel body 102. The channel housing 114 may be affixed to the barrel body 102 in any appropriate manner, including but not limited to friction fit, interference fit, mechanical fasteners (e.g., rivets, screws, etc.), adhesives, welding, brazing, other methods of connection, or combinations thereof.

The channel housing 114 has an aperture 118 therein to allow fluid communication with a gas block 120. The channel housing 114 rotationally aligns with the barrel body 102 such that the aperture 118 may rotationally align with the gas channel 104. The aperture 118 is located on the channel housing 114 to align with a distal end of the gas channel 104. When the channel housing 114 is positioned about the barrel body 102, the gas channel 104 is substantially enclosed with the gas port 108 near a proximal end of the gas channel 104 and the aperture 118 near the distal end of the gas channel 104. The gas channel 104 thereby provides fluid communication between a central bore of the barrel 100 to the gas block 120. The gas block 120 has an outlet 122 that directs gas toward one or more components of an operating group to cycle a firearm.

A length of the gas channel 104 and a length of the barrel 100 may have a ratio in a range having upper and lower values including any of 0.1, 0.2, 0.3, 0.4, 0.5, 0.6, 0.7, 0.8, 0.9, 1.0, or any value therebetween. For example, the length of the gas channel 104 and the length of the barrel 100 may have a ratio between about 0.2 and about 0.9. In another example, the length of the gas channel 104 and the length of the barrel 100 may have a ratio between about 0.3 and about 0.7. In yet another example, the length of the gas channel 104 and the length of the barrel 100 may have a ratio between about 0.4 and about 0.6. In at least one embodiment, the length of the gas channel 104 and the length of the barrel 100 may have a ratio of about 0.5.

The channel housing 114 and/or outer surface 106 of the barrel body 102 may have one or more alignment features to limit the orientations in which the channel housing 114 and barrel body 102 may be positioned relative to one another. For example, the channel housing 114 may have a notch that cooperates with a protrusion in the outer surface 106 of the barrel body 102 to aid in alignment of the aperture 118 in the channel housing 114 with the gas channel 104 integrated in the barrel body 102.

Figure 2:
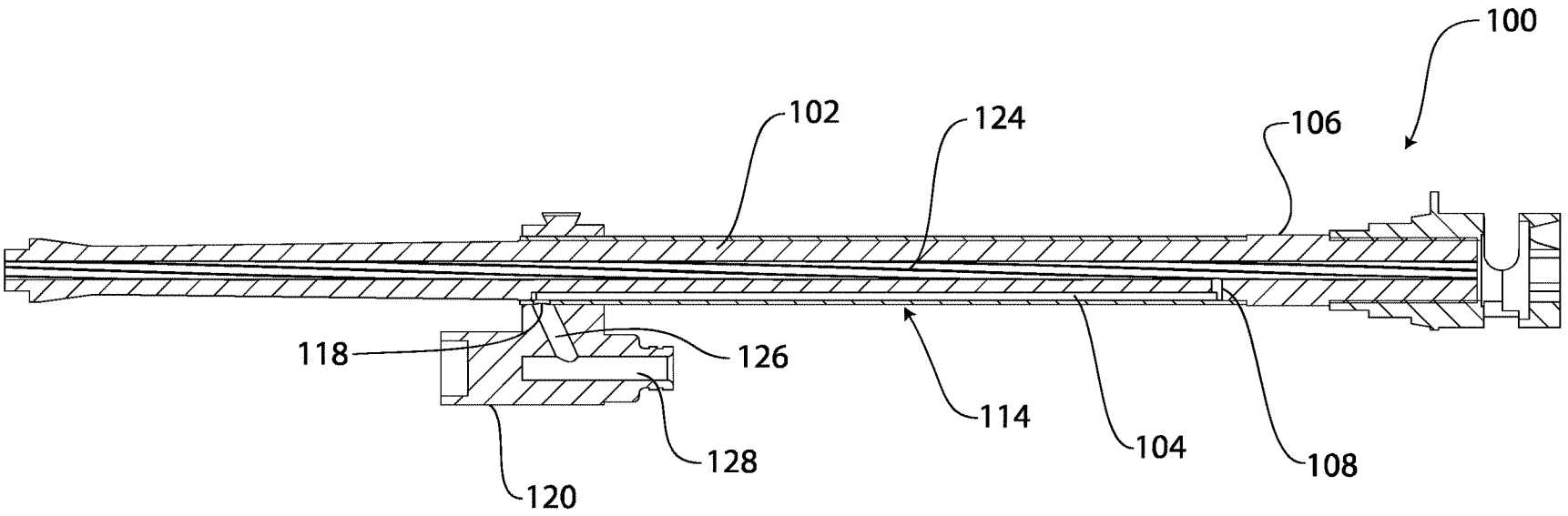
FIG. 2 is a side cross-sectional view of the barrel of FIG. 1 in an assembled configuration.

FIG. 2 is a side cross-sectional view of the barrel 100 in an assembled configuration with an integrated gas channel 104. A barrel body 102 of the barrel 100 has a gas channel 104 formed in an outer surface 106 thereof and covered by a channel housing 114. An axis of the gas channel 104 extends longitudinally and substantially parallel to an axis of the central bore 124 of the barrel 100. The gas channel 104 extends from a gas port 108 adjacent the proximal end 110 of the barrel 100 in a distal direction to an aperture 118 in the channel housing 114. The aperture 118 allows fluid communication with a lateral vent 126 through at least part of the gas block 120 to a gas block chamber 128. The lateral vent 126 and gas block chamber 128 directs expanding gas received from the aperture 118 proximally toward an operating group to cycle a firearm.

The gas block chamber 128 is, therefore, in fluid communication with the central bore 124 of the barrel 100 via the gas channel 104. Expanding gas from central bore 124 moves through the gas port 108 and pressurizes the gas in the gas port 108, gas channel 104, lateral vent 126, and gas block chamber 128.

Figure 3:
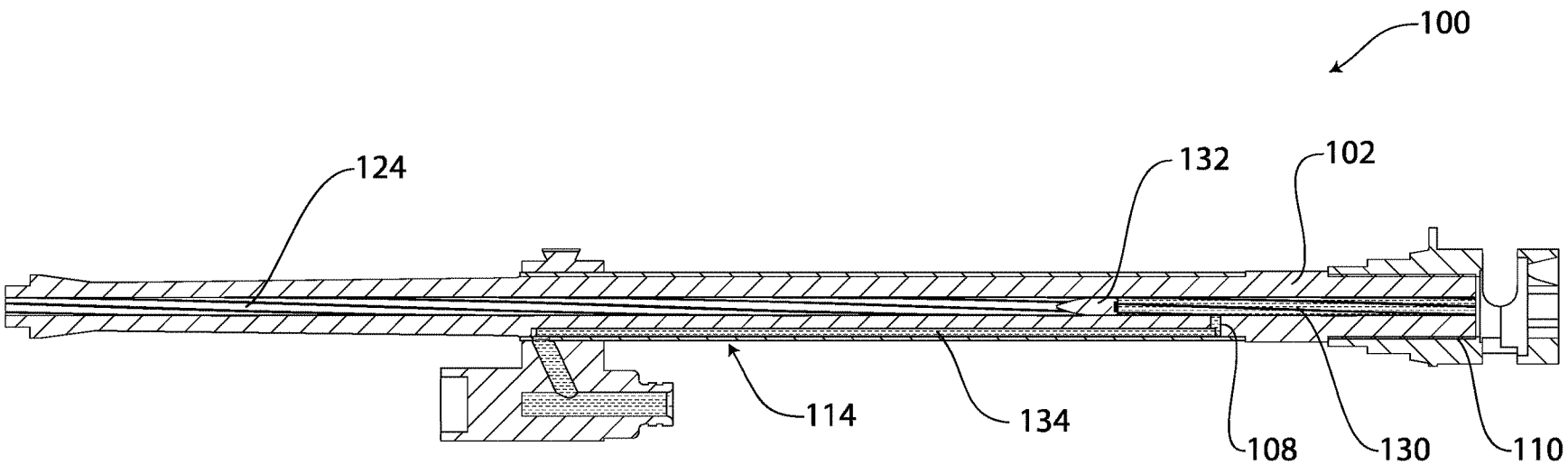
FIG. 3 is a side cross-sectional view of the assembled barrel of FIG. 2, wherein a bullet is located in a central bore and obstructing the path of expanding gas.

As shown in FIG. 3, the barrel 100 diverts expanding gas 130 from the central bore 124 of the barrel body 102 after a bullet 132 is fired through the barrel 100. The barrel 100 diverts the expanding gas 130 from the central bore 124 via a gas port 108. The location of the gas port 108 near the proximal end 110 of the barrel body 102 allows the barrel 100 to divert expanding gas 130 for a longer period of time ("dwell time") when compared to a conventional gas operated firearm. The increased dwell time allows the barrel 100 to harness more energy from the expanding gas 130.

The diverted gas 134 compresses and expands in the gas channel 104. The additional length and/or volume in which the diverted gas 134 may move in the gas channel 104 allows for a more gradual application of force to an operating group when compared to a conventional gas operated firearm, reducing wear on the operating group. The more gradual application of force to an operating group may allow for the use of lighter and/or smaller components within the firearm. The use of lighter and/or smaller components in a firearm may reduce overall weight and improve control of the firearm.

FIG. 3 depicts a gas channel 104 that is partially defined by the barrel body 102 of the barrel 100 and partially defined by the channel housing 114. The diverted gas 134 may include one or more contaminants that may foul or otherwise damage the gas channel 104. The channel housing 114 may be selectively removable to grant a user access to the portion of the barrel body 102 and/or the portion of the channel housing 114 that define the gas channel 104. A user may clean or otherwise perform maintenance on the portion of the barrel body 102 and/or the portion of the channel housing 114 that define the gas channel 104 to improve operation of and/or extend the operational lifetime of the barrel 100.

Figure 4:
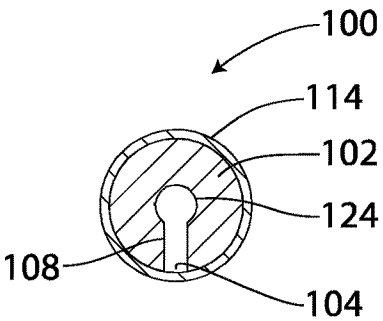
FIG. 4 is a transverse cross-sectional view of the assembled barrel of FIG. 2.

FIG. 4 depicts the barrel 100 of FIG. 2 with the central bore 124 extending longitudinally therethrough. The central bore 124 has a gas port 108 extending lateral therefrom through a portion of the barrel body 102 to the gas channel 104. FIG. 4 is a transverse cross-section taken through the barrel body 102 of the barrel 100 at the longitudinal position where the gas port 108 is in fluid communication with the gas channel 104. The gas channel 104 is formed in the barrel body 102, but is bordered and enclosed by the channel housing 114. For example, the gas channel 104 is formed in the barrel body 102 of the barrel 100 as a recess in the barrel body 102 which is open along a portion of the gas channel 104 (i.e., an outer surface). The channel housing 114 may cover the open portion, substantially closing the periphery of the gas channel 104.

Figure 5:
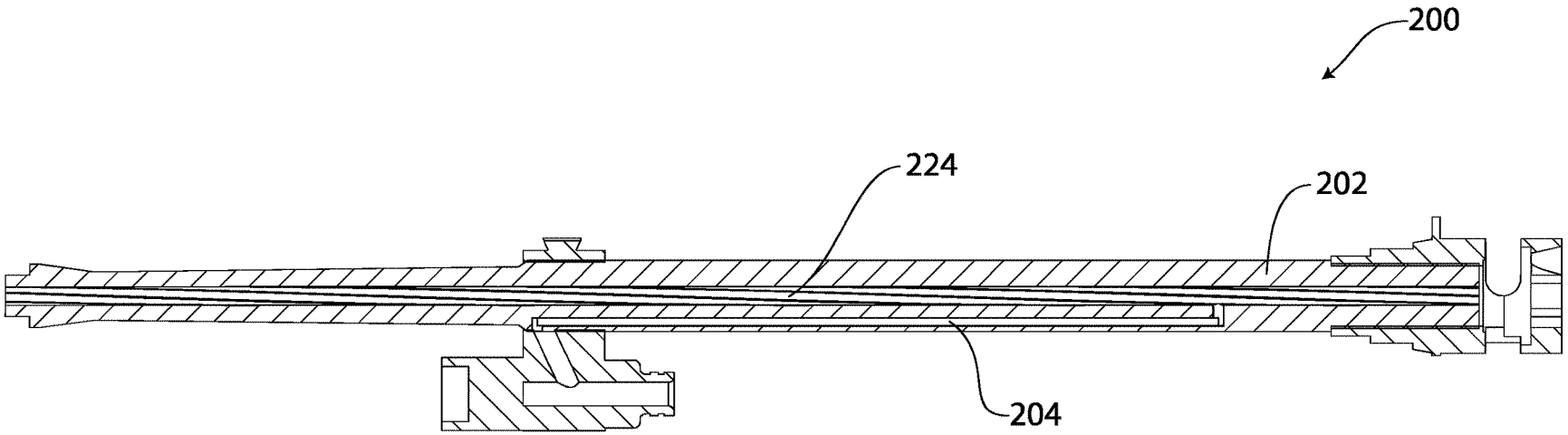
FIG. 5 is a side cross-sectional view of an alternative barrel having a bore, a gas port, and a gas channel, wherein the gas channel is integral within the barrel body.

Referring now to FIG. 5, in another embodiment, a barrel 200 according to the present disclosure has a gas channel 204 within a barrel body 202 of the barrel 200. In the embodiment depicted in FIG. 5, the barrel body 202 of the barrel 200 has a central bore 224 extending longitudinally therethrough. A gas channel 204 extends through at least a portion of the barrel body 202. A barrel 200 having a gas channel 204 within at least a portion of the barrel body 202 does not include a channel housing, such as that described in relation to FIG. 1, as the gas channel 204 is defined by the barrel body 202 of the barrel 200 only.

In the depicted embodiment, the gas channel 204 is substantially perpendicular to the central bore 224. In other embodiments, the gas channel may be oriented at an angle relative to the central bore. In the depicted embodiment, the gas channel 204 is substantially straight. In other embodiments, at least part of the gas channel may be curved or may have an angle therein. In the depicted embodiment, the gas channel 204 is substantially uniform in transverse cross-section. In other embodiments, the gas channel may vary in shape and/or area in transverse cross-sectional along at least a portion of the length of the gas channel.

Figure 6:
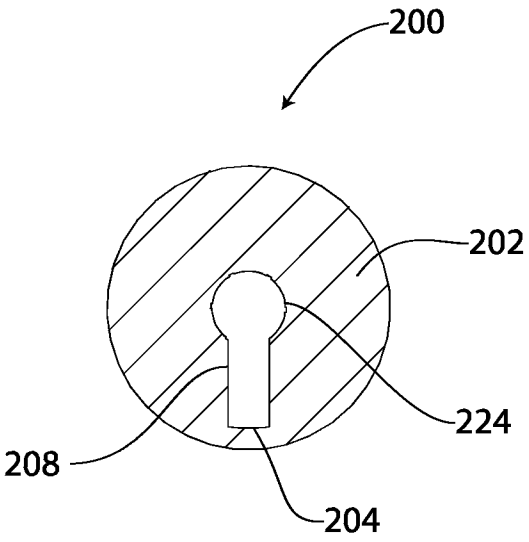
FIG. 6 is a transverse cross-sectional view of the barrel of FIG. 5.

FIG. 6 is a transverse cross-section of another embodiment of the barrel 200 of FIG. 5. The transverse cross-section is taken through the barrel body 202 of the barrel 200 at the longitudinal position where the gas port 208 is in fluid communication with the gas channel 204. The gas port 208 extends laterally from a central bore 224 to the gas channel 204. The gas channel 204 then extends longitudinally and substantially parallel to the central bore 224. In the depicted embodiment, the gas port 208 extends laterally from the central bore 224 through a portion of the barrel body 202 to a gas channel 204. The gas channel 204 is integral within the barrel body 202. The barrel 200 depicted in FIG. 6 does not include a channel housing and the gas channel 204 is defined entirely by the barrel body 202 of the barrel 200.

Figure 7:
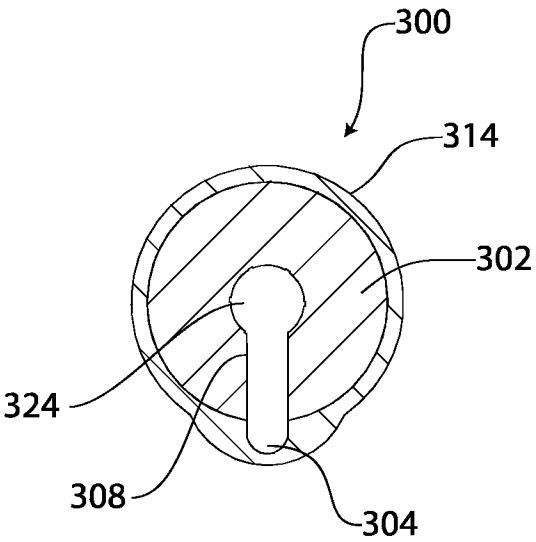
FIG. 7 is a transverse cross-sectional view of another alternative barrel having a bore and a gas port and a channel housing positioned around the barrel partially defining a gas channel in fluid communication with the gas port.

FIG. 7 depicts a barrel 300 with a barrel body 302 and a channel housing 314 cooperating to define at least a part of a gas channel 304. Similarly to FIG. 6, FIG. 7 is a transverse cross-section taken through the barrel body 302 of the barrel 300 at the longitudinal position where a gas port 308 is in fluid communication with the gas channel 304. FIG. 7 depicts a barrel 300 having a central bore 324 and a gas channel 304 that extend in a longitudinal direction substantially parallel to one another. The central bore 324 and the gas channel 304 are in fluid communication with one another via the gas port 308 that extends laterally from the central bore 324 through and out of the barrel body 302 to the gas channel 304. The gas channel 304 is at least partially outside the barrel body 302 of the barrel 300. The gas channel 304 is partially defined by the barrel body 302 and partially defining by a channel housing 314 positioned circumferentially about the barrel body 302 of the barrel. In other embodiments, the gas channel 304 may be entirely outside the barrel body 302 of the barrel 300 and may be defined by a bore through the channel housing 314. In the depicted embodiment, the channel housing 314 has an increased radius near the gas channel 304. In other embodiments, the radius the channel housing 314 be substantially uniform.

Figure 8:
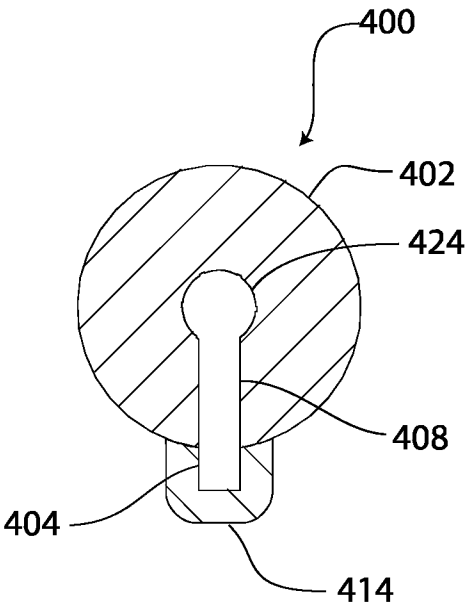
FIG. 8 is a transverse cross-sectional view of yet another alternative barrel having a bore and a gas port and a channel housing affixed to a portion of the barrel and defining a gas channel within the channel housing in fluid communication with the gas port.

FIG. 8 depicts a barrel 400 having a channel housing 414 that defines a gas channel 404 external to a barrel body 402 of the barrel 400. The channel housing 414 is affixed to the barrel body 402 and does not extend circumferentially about the barrel body 402. The channel housing 414 may extend around a portion of the barrel body 402 that is less than an entire circumference, as shown in FIG. 8. Similarly to FIG. 6, FIG. 8 is a transverse cross-section taken through the barrel body 402 of the barrel 400 at the longitudinal position where a gas port 408 is in fluid communication with the gas channel 404. The gas port 408 extends laterally from a central bore 424 of the barrel 400 out of the barrel body 402. The channel housing 414 is located adjacent to the barrel body 402 with a gas channel 404 formed in the channel housing 814. The depicted embodiment provides a gas channel 404 extending longitudinally and parallel to the central bore 424 of the barrel 400 to be retrofit to a conventional barrel.

Figure 9:
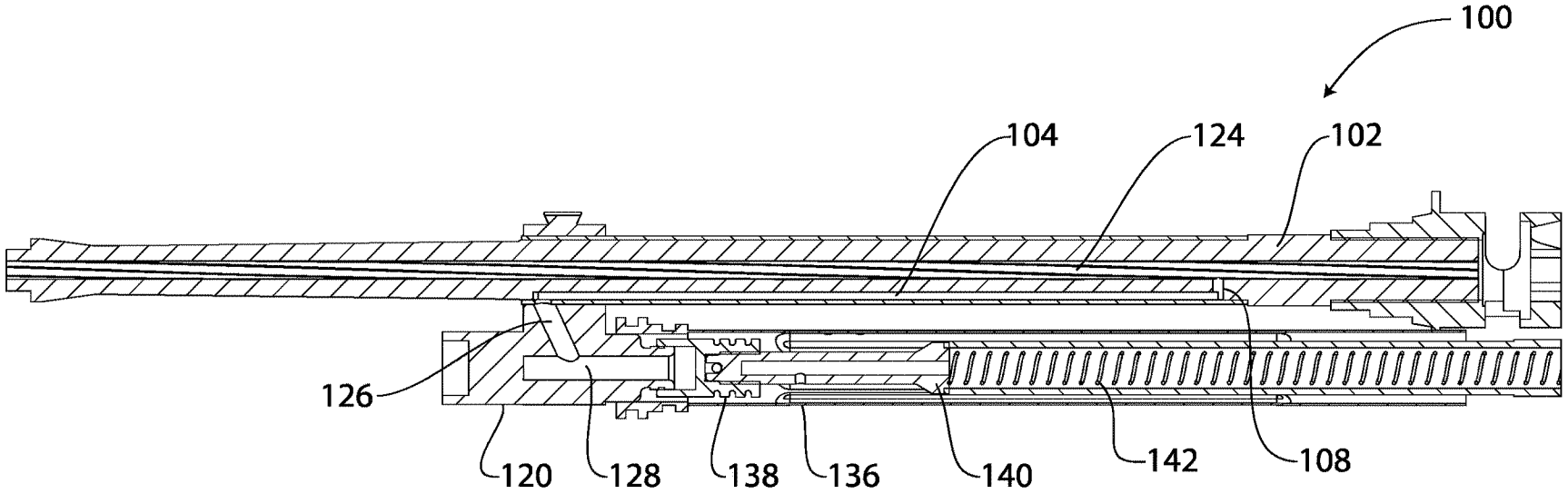
FIG. 9 is a side cross-sectional view of the assembled barrel of FIG. 2 configured to direct a fluid to a gas cylinder and piston.

As described herein, a barrel with an integrated gas channel diverts a portion of an expanding gas in the barrel distally along a gas channel to a gas block, which may, in turn, harness the energy of the diverted gas to move an operating group. FIG. 9 is a side cross-sectional view of the assembled barrel 100 of FIG. 2 with the integrated gas channel 104 that directs gas to a gas cylinder 136 containing a gas piston 138 and an op rod 140. While FIG. 9 depicts a gas piston design, it should be understood that a barrel according to the present disclosure may be used with other gas operated firearm designs, such as a direct impingement or gas impingement design. The barrel body 102 of the barrel 100 contains the central bore 124 with the gas port 108 extending laterally therefrom. The gas port 108 diverts gas through the gas channel 104 to the lateral vent 126 in the gas block 120. The gas block 120 includes the gas block chamber 128 that is open at one end. The gas block chamber 128 directs the diverted gas proximally to impinge upon the gas piston 138 contained within the gas cylinder 136. The diverted gas applies a compressive force to the gas piston 138 moving the gas piston 138 and the associated op rod 140. The movement of the gas piston 138 and the op rod 140 may cycle a firearm. The movement of the gas piston 138 and the op rod 140 compresses a spring 142 in contact with the gas piston 138 and/or the op rod 140. The spring 142 applies a restoring force to the gas piston 138 and/or the op rod 140 to accelerate the gas piston 138 and/or the op rod 140 back toward the gas block 120, thereby resetting the position of the components depicted in FIG. 9.

As illustrated in FIG. 9, the gas channel 104 in communication with the gas port 108 directs the diverted portion of the expanding gas toward the aperture 118 communicating with the gas block 120 where the gas is used to cycle an operating group (which includes gas piston 138 and op rod 140, for example) of the firearm. As illustrated in FIG. 9, muzzle end of the barrel body 102 is a distal end 112 of the barrel body 102 and a proximal end 110 of the barrel body 102 is configured to be placed adjacent a chamber of a firearm. Gas channel 104 is in communication with the gas port 108 located adjacent the proximal end 110, as shown in FIG. 9, the gas port 108 communicating with the central bore 124, such that gas expanding through the central bore 124 moves through the gas port 108, into the gas channel 104 and into a gas block 120 mounted on the elongated barrel body 102.

As shown in FIG. 9, the gas port 108 is located proximally of a midpoint of the central bore 124. More specifically, gas port 108 is located in a proximalmost quarter of the central bore 124.

The position of the gas port 108 near the proximal end of the barrel body 102 allows the gas port 108 to receive the expanding gas from firing a bullet sooner than a gas port located near a distal end of a conventional barrel. The gas port 108 will, therefore, receive higher pressure gas for a longer period of time. The barrel 100 will thus harness a larger amount of energy from the firing of a bullet as compared to a conventional barrel, and the barrel 100 will allow lower energy ammunition to operate in a greater variety of firearms. Barrel 100 thus increases the amount of energy harnessed from the expanding gas behind a bullet by having the gas port 108 near the proximal end of the barrel that is in communication with the bore of the barrel. Since the gas pressure is highest near the chamber of the firearm, gas port 108 near the chamber, i.e., near the proximal end of the barrel body 102, will experience the high gas pressure for a longer period of time than a gas port located closer to the distal end of the barrel.

Figure 10:
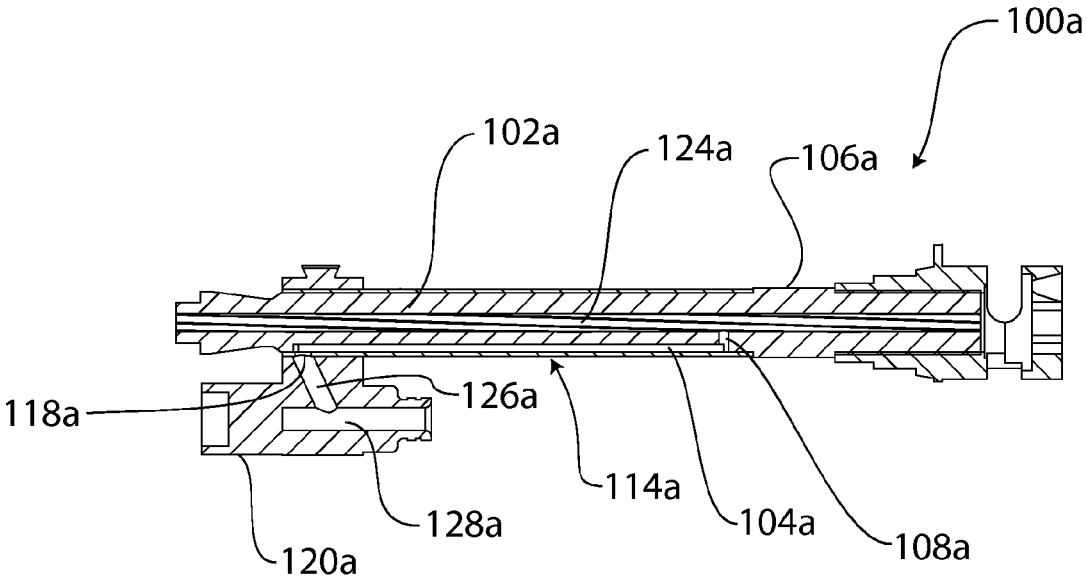
FIG. 10 is a side cross-sectional view of another embodiment of an assembled barrel.

FIG. 10 depicts another embodiment of a barrel 100*a* having a shortened barrel body 102*a* when compared to the barrel 100 of FIG. 2. The gas channel 104*a* of barrel 100*a* is in fluid communication with a central bore 124*a* via a gas port 108*a* located in a proximal two-fifths of the central bore 124*a*, which will experience the high gas pressure for a longer period of time than a gas port located closer to the distal end of the barrel. In other embodiments, the gas port may be located in a proximalmost third of the central bore. In yet other embodiments, the gas port may be located in a proximalmost fifth of the central bore.

A barrel having an integrated gas channel may allow a greater variety of ammunition, caliber, and firearm designs to be used in combinations while providing the appropriate energy to reliably cycle an operating group of a firearm. For example, more energy may be harnessed from low energy ammunition, or the energy delivery from a high energy round may be controlled more precisely to improve control and stability of the firearm while reducing wear on the firearm.

An example of an operating group of a gas-operated firearm which can be used in conjunction with the embodiments described herein is disclosed in U.S. Provisional Patent Application No. 61/926,755 entitled "6.8MM SPC CONVERSION KIT" filed Jan. 13, 2014, the disclosure of which is incorporated herein by reference in its entirety.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "proximal" or "distal" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed:

1. A barrel for a firearm, the barrel comprising:

an elongate body having a longitudinal axis extending from a first end to a second end of the elongate body;

the elongate body having a central bore extending through a length of the elongate body, the bore having a central longitudinal axis, wherein a wall of the elongate body extends from an outer surface of the elongate body to the central bore;

the wall of the elongate body having a gas channel therein, wherein the gas channel is in fluid communication with the central bore, at least part of the gas channel extending along a portion of the length of the elongate body; wherein the gas channel has a longitudinal axis that is substantially parallel to and offset from the longitudinal axis of the central bore;

wherein the gas channel is an enclosed bore extending within the wall of the elongate body, wherein the gas channel is at least partially enclosed by a channel housing.

2. The barrel of claim 1, wherein the gas channel is at least partially defined by the elongate body.

3. The barrel of claim 1, wherein the channel housing extends circumferentially about at least part of an outer surface of the elongate body.

4. The barrel of claim 1, wherein the channel housing is a sleeve.

5. The barrel of claim 4, wherein the sleeve is selectively connected to an outer surface of the elongate body.

6. The barrel of claim 1, wherein a muzzle end of the barrel is a distal end of the barrel and a proximal end of the barrel is configured to be placed adjacent a chamber of a firearm, and wherein the gas channel of the barrel is in communication with a gas port located adjacent the proximal end of the barrel, the gas port communicating with the central bore of the barrel, such that gas expanding through the central bore moves through the gas port, into the gas channel and into a gas block mounted on the elongate body.

7. A barrel for a firearm, the barrel having an integrated gas channel, the barrel comprising:

an elongate body having a longitudinal axis extending from a first end to a second end of the elongate body;

a central bore extending through the elongate body, the bore having a central longitudinal axis, wherein a wall of the elongate body extends from an outer surface of the elongate body to the bore;

a gas port located in fluid communication with the central bore of the barrel; and a gas channel in the wall of the elongate body of the barrel in fluid communication with the gas port, at least part of the gas channel extending through the elongate body along a portion of the length of the elongate body, wherein the gas channel extends substantially parallel to and offset from the longitudinal axis of the central bore;

wherein the gas channel is enclosed by a channel housing, and wherein the channel housing is coupled to an outer surface of the elongate body.

8. The barrel of claim 7, wherein the channel housing extends circumferentially about at least part of an outer surface of the elongate body.

9. The barrel of claim 8, wherein the channel housing is a sleeve that is connected to an outer surface of the elongate body.

10. The barrel of claim 9 wherein the sleeve is selectively connected to the outer surface of the elongate body.

11. The barrel of claim 9, wherein the channel housing has an aperture that is configured to be aligned with the gas channel.

12. The barrel of claim 7, wherein a ratio of a length of the gas channel and a length of the elongate body is between 0.1 and 1.0.

13. The barrel of claim 7, wherein the gas port is located proximally of a midpoint of the central bore.

14. The barrel of claim 7, wherein the gas port is located in a proximalmost two-fifths of the central bore.

15. The barrel of claim 7, wherein the gas port is located in a proximalmost quarter of the central bore.

16. A barrel for a firearm, the barrel comprising:

an elongate body having a longitudinal axis extending from a first end to a second end of the elongate body;

the elongate body having a central bore extending through the elongate body, the bore having a central axis, wherein a wall of the elongate body extends from an outer surface of the elongate body to the bore;

a gas port located in fluid communication with the central bore of the barrel;

a gas channel in the wall of the elongate body of the barrel in fluid communication with the gas port, the gas channel extending through a portion of the length of the elongate body, and a channel housing configured to enclose the gas channel, the channel housing extending circumferentially about at least part of an outer surface of the elongate body, wherein the channel housing is a sleeve that is configured to be coupled to an outer surface of the elongate body.

17. The barrel of claim 16, wherein the channel housing is a sleeve that is configured to be selectively connected to an outer surface of the elongate body, the sleeve configured to be aligned with the elongate body such that an aperture in the channel housing aligns with the gas channel.

18. A barrel for a firearm, the barrel comprising:

an elongate body having a longitudinal axis extending from a first end to a second end of the elongate body;

the elongate body having a central bore extending through the elongate body, the bore having a central axis, wherein a wall of the elongate body extends from an outer surface of the elongate body to the bore;

a gas port located in fluid communication with the central bore of the barrel;

a gas channel in the wall of the elongate body of the barrel in fluid communication with the gas port, the gas channel extending through a portion of the length of the elongate body, and a channel housing configured to enclose the gas channel, the channel housing extending circumferentially about at least part of an outer surface of the elongate body, wherein the channel housing is a sleeve that is coupled to an outer surface of the elongate body.

* * * * *